US006019535A

United States Patent [19]

Turner

[11] Patent Number: 6,019,535

[45] **Date of Patent: *Feb. 1, 2000**

[54] FELT-TIP PEN COVER WITH ERASER

[75] Inventor: Patricia Turner, Itasca, Ill.

[73] Assignee: Chelsea Group Ltd., Itasca, Ill.

[ * ] Notice: This patent is subject to a terminal disclaimer.

[21] Appl. No.: 09/144,705

[22] Filed: Sep. 1, 1998

Related U.S. Application Data

[63] Continuation-in-part of application No. 08/844,937, Apr. 23, 1997, Pat. No. 5,871,294, which is a continuation-in-part of application No. 08/586,990, Jan. 16, 1996, abandoned.

[51] Int. Cl.[7] ..... B43K 29/00; B43K 5/00; B43K 23/08

[52] U.S. Cl. ..... 401/52; 15/428; 401/98; 401/198; 401/202; D19/43; D19/53

[58] Field of Search ..... 401/52, 202, 98, 401/198; 15/428, 427; D19/43, 53

[56] References Cited

U.S. PATENT DOCUMENTS

| | | | |
|---|---|---|---|
| D. 151,307 | 10/1948 | Weston | D19/53 X |
| D. 286,546 | 11/1986 | Funahashi | 401/202 X |
| D. 330,388 | 10/1992 | Choi | 401/199 X |
| 840,372 | 1/1907 | Reckendorfer | 401/52 X |
| 3,656,201 | 4/1972 | Alcocer | 401/131 X |
| 3,834,823 | 9/1974 | Seregely et al. | 401/198 |
| 3,985,455 | 10/1976 | Wahlberg | 401/30 |
| 4,557,618 | 12/1985 | Iwata et al. | 401/34 |
| 4,865,479 | 9/1989 | Doll | 401/17 |
| 5,044,804 | 9/1991 | Chuang | 401/34 |
| 5,072,483 | 12/1991 | Durand | 401/202 X |
| 5,127,130 | 7/1992 | Copito | 15/428 |
| 5,221,152 | 6/1993 | Chuang | 401/202 X |
| 5,338,123 | 8/1994 | Obersteller et al. | 401/34 |
| 5,417,748 | 5/1995 | Kawashima | 106/27 |
| 5,871,294 | 2/1999 | Turner | 401/52 |

*Primary Examiner*—David J. Walczak
*Assistant Examiner*—Kathleen J. Prunner
*Attorney, Agent, or Firm*—Clifford Kraft

[57] ABSTRACT

An eraser is placed on or near the end of the cover of a felt tip pen. The cover is inserted into the bottom of the pen or on the bottom of the pen itself. For a tapered cover type of pen, the eraser is placed on the flat upper end. For a raised or dimple type of cover, the eraser is placed concentrically around the end away from the dimple like a girdle or belt or flat on the bottom of the pen body. On a type of pen that resembles a fountain pen, the eraser is placed on the top cover on a flat area that may be slightly angled. The eraser can also be an annular ring on the base of the pen body. The eraser can be removable from the pen or can be attached with adhesive.

9 Claims, 3 Drawing Sheets

FELT-TIP PEN COVER WITH ERASER

This is a Continuation-In-Part of application Ser. No. 08/844,937, Apr. 23, 1997 now U.S. Pat. No. 5,871,294 which was a Continuation-In-Part of application Ser. No. 08/586,990 Jan. 16, 1996 now abandoned.

BACKGROUND

1. Field of the Invention

This invention relates generally to the field of writing instruments and more particularly to a felt tip pens with an eraser, in particular, a removable eraser.

2. Description of the Related Art

Previous systems comprise several major types of felt tip pens and covers, none of which have erasers. One type of pen has a small circular raised area on the top of a cover for insertion into the bottom of the pen when the pen is in use; a second type consists of a tapered cylindrical cover that is reversed and inserted into the bottom of the pen when the pen is in use. A third type of felt tip marker resembles a fountain pen. This type has a removable cover that is inserted over the base of the pen when writing.

None of these previous systems is equipped with any type of eraser. Yet, numerous circumstances arise during the use of a felt tip pen at a whiteboard (or any writing board) where a minor correction is required. Erasing the dried ink from the board requires searching for a full sized board eraser. This means picking up the large eraser with a second hand and erasing while still holding the pen in the first hand.

Sometimes a large eraser cannot be found. Either the room containing the whiteboard was not equipped with one, or it has been misplaced. In this case, the lecturer must generally wipe the colored ink from the board with his or her hand or palm. In either case, the colored ink is transferred to the skin causing a mess that can then accidently be transferred to clothing or elsewhere.

What is very badly needed is a felt tip pen with an eraser on its cover or elsewhere. This eraser need not be large since it would not necessarily be used to erase an entire board, but rather to simply make corrections. What is also needed, is a felt tip pen eraser that can be removed and fitted on a different pen.

SUMMARY OF THE INVENTION

The present invention relates to an improved felt tip pen with an attached and possibly removable eraser. The invention places an eraser on the end of the cover that is not inserted into the bottom of the pen or on the end of the pen body.

For the tapered cover type of pen, the eraser is placed on the flat upper end. For the raised or dimple type, the eraser is placed concentrically around the end away from the dimple like a girdle or belt. This is necessary since that end is also used to cover the felt wick. The third type of pen resembles a fountain pen. Here the eraser is placed on the top of the cover on a flat area that may be angled slightly. An alternative is to place an annular eraser on the flat bottom of the raised or dimple type. The eraser resembles a flat doughnut on the end of the pen. The hole in the center of the eraser allows insertion of the pen cover into the base of the pen in the normal way.

An important feature of the present invention is that the eraser can be removable from the pen cap. This allows erasers to be supplied separate of pens and merely pressed onto the pen or pen cap by the user when a new pen is obtained. This allows the eraser to be used with any pen on the market without the pen maker having to supply the eraser.

BRIEF DESCRIPTION OF THE DRAWINGS

For a more complete understanding of this invention, reference should now be made to the embodiments illustrated in greater detail in the accompanying drawings and described below by way of examples of the invention.

It should be understood, of course, that the invention is not necessarily limited to the particular embodiments illustrated herein.

DESCRIPTION OF PREFERRED EMBODIMENTS

Figure 1:
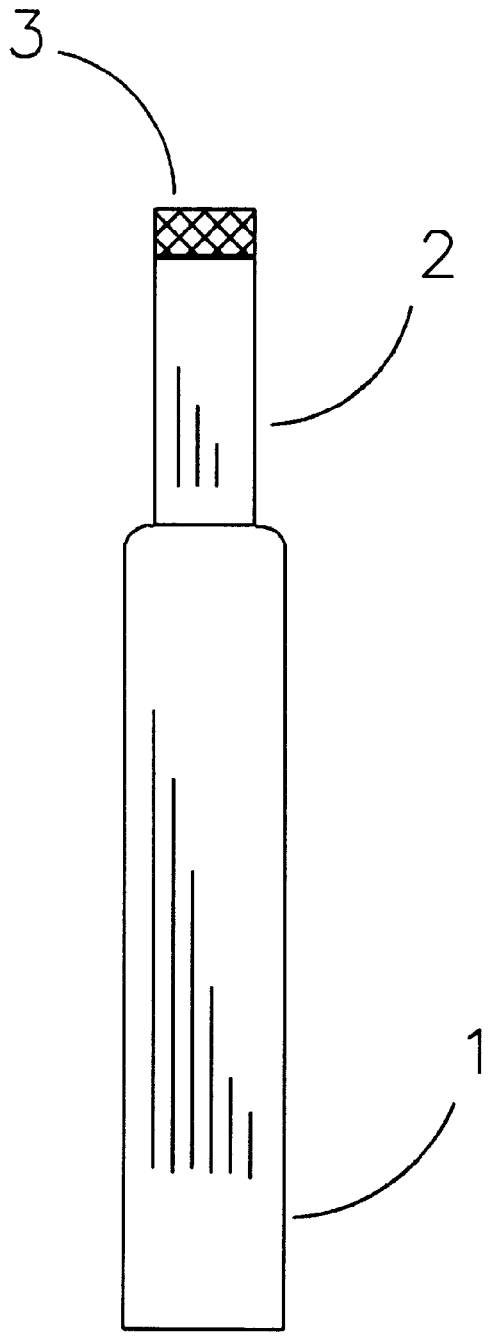
FIG. 1 shows the tapered type of pen cover with the eraser mounted on the top of the cover.

Turning to FIG. 1, one of the major types of pens manufactured today can be seen. There is a cylindrical body 1, and a cylindrical cap 2. The cap 2 is tapered slightly at its base or top (taper not shown) so that the tapered end can be inserted into the bottom of the body 1. The body 1 contains ink and a wick that extends out the top of the pen (not shown).

FIG. 1 shows an embodiment of the invention with a pad or layers of pliable material 3 mounted on the top of the cap 2 to form an eraser. This material 3 can be felt or any other layered or non-layered material that can be used to erase a whiteboard. This eraser pad can be glued, epoxied, superglued, or attached by any other manner that causes it to be firmly affixed. The eraser material can be impregnated with a organosilicone fluid, if desired, to enhance dust retention.

When the pen is in the writing position with the cap stuck into the bottom, the eraser faces out the back of the pen. This is a very convenient position for the eraser since the user needs only turn the hand slightly to erase or make small corrections.

Figure 2:
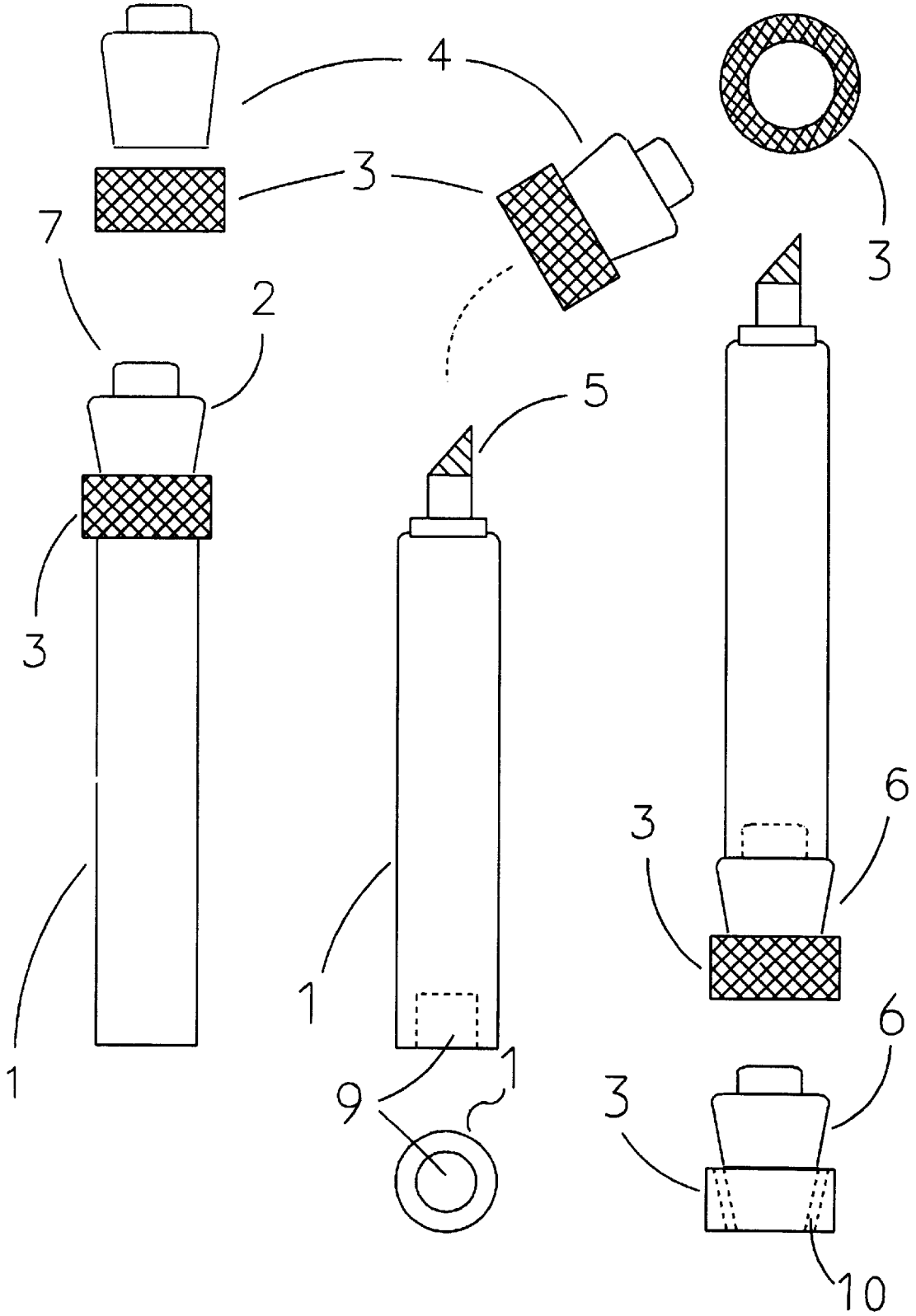
FIG. 2 shows the dimple type of pen cover with the eraser mounted concentrically around the bottom of the cover. The removability of the eraser is shown.

FIG. 2 shows another major type of felt tip pen on the market. There is a generally cylindrical body 1, and a cap or cover 2. In this case, the cover 2 contains a small circular raised area or dimple 7. This dimple 7 is used to hold the cap in the bottom of the body 1 in the writing position as can be clearly seen in FIG. 2. The body 1 contains ink and a wick which protrudes out the top of the body to form a writing surface 5. The cap 2 is removed from the pen body 1 when it is desired to write. The cap is moved 4 from the top of the pen to the bottom with the dimple inserted into the body. The cap in this position is firmly held to the pen body. The cylindrical body 1 contains a circular aperture 9 into which the cap 4 can be inserted.

An embodiment of the present invention places an eraser pad 3 made of felt or other suitable material concentrically around the bottom of the cover 2. The pad 3 forms a belt or girdle around the lower or smaller part of the cover 6. When the cover is place in the bottom of the base for writing, the eraser pad 3 is exposed and in position to erase. The eraser pad 3 is also exposed when the cover 2 is in the closed position. This particular embodiment is particularly easy to use since the user need not change the position of the hand to erase. The user simple turns the hand very slightly to expose the eraser pad 3 and then applies it to the board to erase.

The eraser pad 3 in this embodiment can be removed and replaced if necessary or it can be attached with a layer of glue or other adhesive 10. This is clearly shown in FIG. 2. The pad itself is a circular disk with a central aperture cut out. If this aperture is small enough, the disk will grip the pen cap or pen body tight enough to stay in place without adhesive of any type. This feature is particularly useful for fitting an eraser pad to a pen obtained without an eraser. In other words, the user can simply take any pen of this type and fit it with an eraser. In this manner, the eraser pads can be supplied separately from the pen, and the invention can be fitted to any pen by supplying the pads with different size center apertures to fit various sizes of pens.

Figure 3:
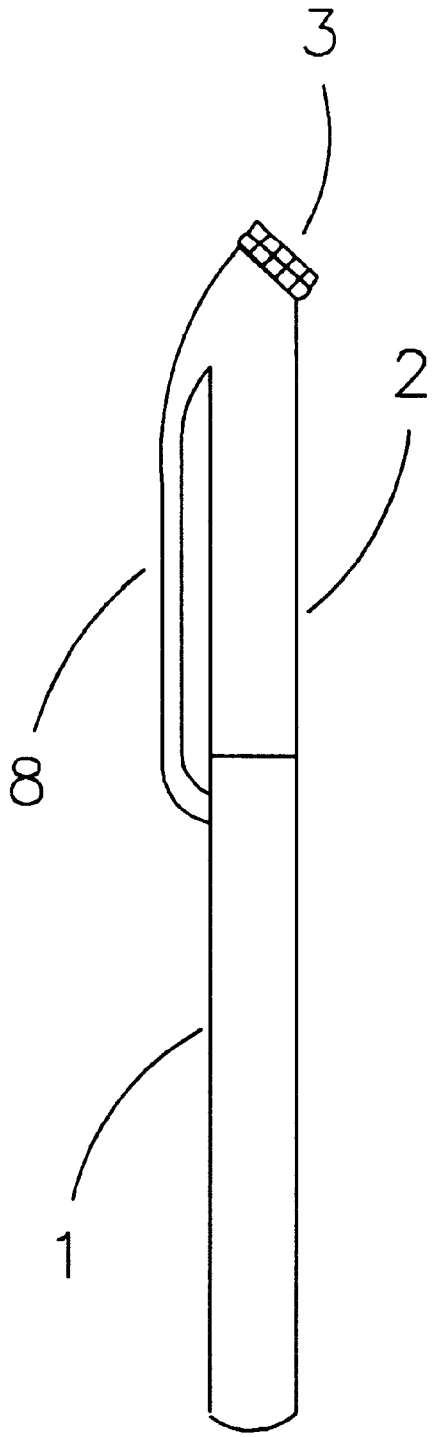
FIG. 3 shows the fountain pen type of pen cover with the eraser mounted on the top of the cover.

FIG. 3 shows a third type of pen found on the market, namely one that resembles a fountain pen (with possibly a larger diameter). Here again there is a cylindrical body 1 and a cap or cover 2. There is a pocket clip 8 as well. Due to the position and shape of the pocket clip 8, the eraser pad 3 is positioned on an angled flat portion on the top of the cover 2. In the writing position, the cover 2 is placed over the bottom of the body 1, exposing the eraser pad 3 for erasing.

The manner of attachment of the pad is relatively unimportant as long as the pad cannot move. The pad can be pressed on and made to combine its fibers into the body of the cover or pen, or it can be attached with adhesive or by any other attachment means. The pad can simply fit tight enough to be pressed over the end of the pen or pen cap. In this case, it is removable. The pad can be dry or permanently wetted. It can be untreated, or can contain anti-electrostatic material. The best choice for material is felt; however, any pliable material can be used.

The exact shape of the eraser pad is also not important as long as enough surface area is exposed to erase marks on the board. The mounting positions shown in FIGS. 1–3 are merely representative of embodiments of the present invention and can be altered without major effect. The eraser pad 3 can be mounted anywhere on the cover or body of the pen and still be effective. The present invention can be embodied with any type of pen on the market, and any type that may come onto the market because the eraser can be attached anywhere.

It is to be understood that the above-described arrangements are merely illustrative of the application of the principles of the invention, and that other arrangements may be devised by those skilled in the art without departing from the spirit and scope of the invention.

What is claimed is:

1. An eraser, felt-tip pen combination comprising:

a substantially cylindrical felt tip pen having a body, a base end, and a writing end, said base end having a substantially circular aperture, concentric with said body;

a pen cap used to cover said writing end of said felt-tip pen, said cap also insertable in said aperture in said base end when said pen is used;

a hollow substantially cylindrical eraser pad with top and bottom surfaces, and a side surface, attached to said pen cap, said pen cap inserted through said top and bottom surfaces of said substantially cylindrical eraser pad, said side surface used to make erasures.

2. The eraser, felt-tip pen combination of claim 1 wherein said substantially cylindrical eraser pad is felt.

3. The eraser, felt-tip pen combination of claim 1 wherein said substantially cylindrical eraser pad is glued to said pen cap.

4. An eraser, felt-tip pen combination comprising:

a substantially cylindrical felt tip pen having a body, a base end, and a writing end, said base end having a substantially circular aperture, concentric with said body;

a pen cap used to cover said writing end of said felt-tip pen, said cap also insertable in said aperture in said base end when said pen is used;

a hollow substantially cylindrical eraser pad with top and bottom surfaces, and a side surface, removably attached to said pen cap, said pen cap inserted through said top and bottom surfaces of said substantially cylindrical eraser pad, said side surface used as an eraser.

5. The eraser, felt-tip pen combination of claim 4 wherein said substantially cylindrical eraser pad is cloth.

6. The eraser, felt-tip pen combination of claim 5 wherein said cloth is felt.

7. A writing device comprising a writing means with a base and a removable cap that is inserted into an aperture in said base when the writing device is in use, and a hollow cylindrical eraser pad removably attached to the cap; the eraser pad being placed around the cap so that an outer surface of the eraser pad is exposed and used for making erasures; the eraser pad capable of being placed on and removed from the removable cap.

8. The writing device of claim 7 wherein said eraser pad is cloth.

9. The writing device of claim 8 wherein said cloth is felt.

* * * * *